US009407003B1

(12) United States Patent
Kruse et al.

(10) Patent No.: US 9,407,003 B1
(45) Date of Patent: Aug. 2, 2016

(54) LOW SPECIFIC ABSORPTION RATE (SAR) ANTENNA STRUCTURE

(71) Applicant: AMAZON TECHNOLOGIES, INC., Reno, NV (US)

(72) Inventors: Jay William Kruse, Los Gatos, CA (US); Joseph Christopher Modro, Los Gatos, CA (US); Ming Zheng, Cupertino, CA (US); Jerry Weiming Kuo, San Jose, CA (US)

(73) Assignee: Amazon Technologies, Inc., Reno, NV (US)

( * ) Notice: Subject to any disclaimer, the term of this patent is extended or adjusted under 35 U.S.C. 154(b) by 191 days.

(21) Appl. No.: 14/288,283

(22) Filed: May 27, 2014

(51) Int. Cl.

| | |
|---|---|
| ***H01Q 1/24*** | (2006.01) |
| ***H01Q 1/48*** | (2006.01) |
| ***H01Q 1/52*** | (2006.01) |
| ***H01Q 1/50*** | (2006.01) |
| ***H01Q 9/04*** | (2006.01) |

(52) U.S. Cl.
CPC ..... *H01Q 1/48* (2013.01); *H01Q 1/242* (2013.01); *H01Q 1/245* (2013.01); *H01Q 1/50* (2013.01); *H01Q 1/52* (2013.01); *H01Q 9/0407* (2013.01)

(58) Field of Classification Search
USPC ..... 343/702, 846, 850, 851
See application file for complete search history.

(56) References Cited

U.S. PATENT DOCUMENTS 8,537,057 B2 * 9/2013 Friederich ..... H01Q 1/24 343/702
8,754,822 B1 * 6/2014 Dou ..... H01Q 13/10 343/702
2013/0069847 A1 * 3/2013 Chiang ..... H01Q 1/245 343/893
2013/0293441 A1 11/2013 Zhang

FOREIGN PATENT DOCUMENTS

EP 2 552 028 A1 1/2013
WO 2012/177939 A2 12/2012

OTHER PUBLICATIONS

Holopainen, J., Villanen, J., Valkonen, R, Poutanen, J., Kivekäs, O., Icheln, C., & Vainikainen, P. (Mar. 2009). Mobile terminal antennas implemented using optimized direct feed. In Antenna Technology, 2009. iWAT 2009. IEEE International Workshop on (pp. 1-4). IEEE.

* cited by examiner

*Primary Examiner* — Hoang V Nguyen
(74) *Attorney, Agent, or Firm* — Lowenstein Sandler LLP

(57) ABSTRACT

Antenna structures and methods of operating the same of an electronic device are described. One apparatus includes a radio frequency (RF) including a surface-current dispersing circuit and an antenna structure coupled to the RF feed at a feeding point and coupled to a ground plane at a grounding point. The antenna structure comprises an even multiple of quarter-wavelength elements with a first element coupled to the feeding point and a second element coupled to the grounding point and the grounding point is located at a specified distance from the feeding point. Surface currents, generated as a result of the RF signals being applied to the RF feed at the feeding point, create a first hot spot of an even multiple of hot spots of magnetic field at the feeding point. The surface-current dispersing circuit and the ground point disperse a portion of the surface currents at the feeding point towards the grounding point to create other hot spots of the even multiple of hot spots. The even multiple of hot spots are areas of the antenna structure on which surface-current density is higher than other areas surrounding the areas of the even multiple of hot spots.

20 Claims, 12 Drawing Sheets

LOW SPECIFIC ABSORPTION RATE (SAR) ANTENNA STRUCTURE

BACKGROUND

A large and growing population of users is enjoying entertainment through the consumption of digital media items, such as music, movies, images, electronic books, and so on. The users employ various electronic devices to consume such media items. Among these electronic devices (referred to herein as user devices) are electronic book readers, cellular telephones, personal digital assistants (PDAs), portable media players, tablet computers, netbooks, laptops and the like. These electronic devices wirelessly communicate with a communications infrastructure to enable the consumption of the digital media items. In order to wirelessly communicate with other devices, these electronic devices include one or more antennas.

All consumer portable devices need to meet the FCC's SAR requirement. SAR is a measure of the rate at which energy is absorbed by the body when exposed to a radio frequency (RF) electromagnetic field. In addition, the user's body can block the RF electromagnetic field in the direction of the user's body, thus reducing the gain in that direction.

BRIEF DESCRIPTION OF THE DRAWINGS

The present inventions will be understood more fully from the detailed description given below and from the accompanying drawings of various embodiments of the present invention, which, however, should not be taken to limit the present invention to the specific embodiments, but are for explanation and understanding only.

DETAILED DESCRIPTION

Figure 1:
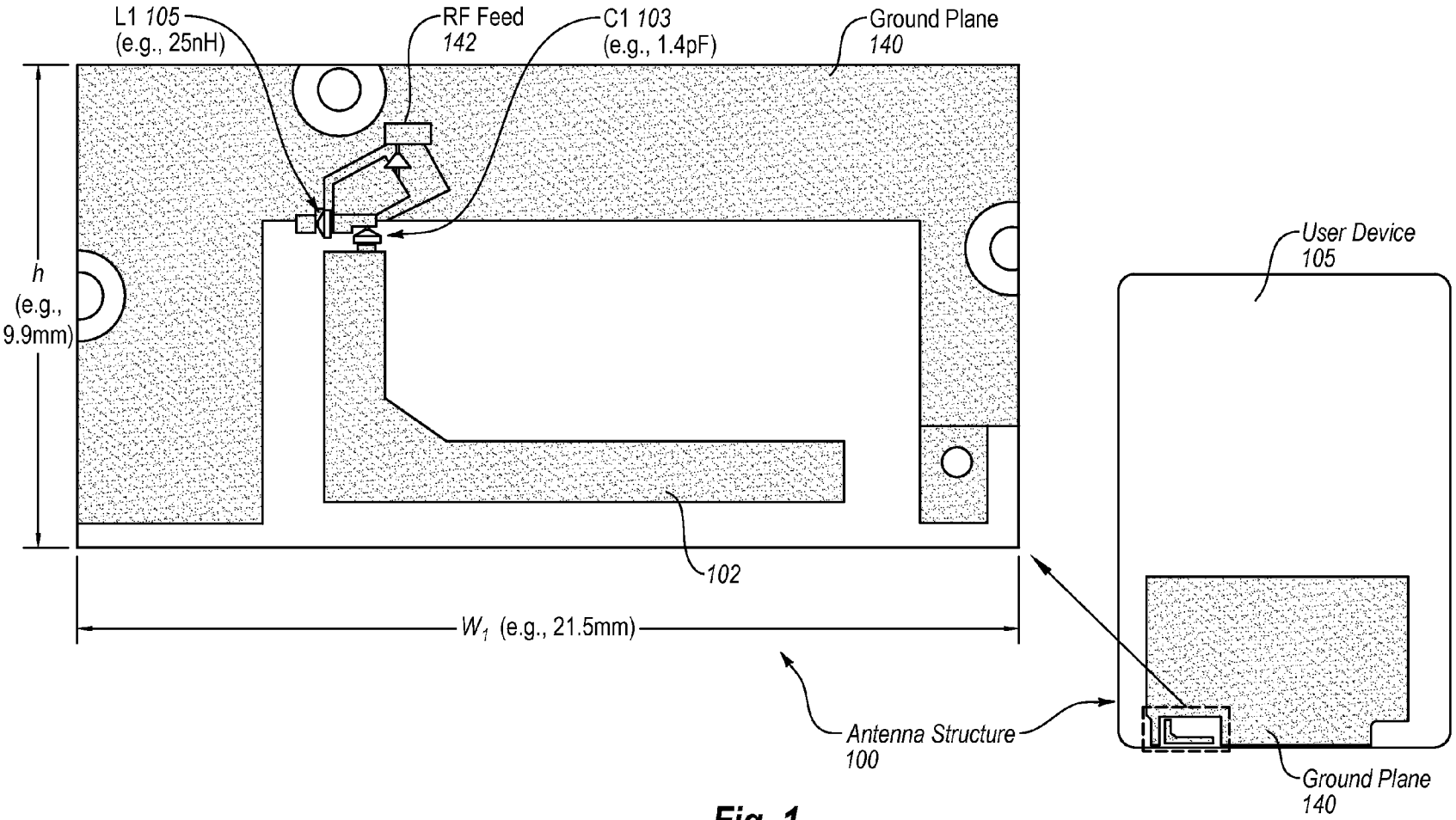
FIG. 1 is a rear view of a user device and a close-up view of a monopole antenna structure according to one implementation.

Antenna structures and methods of operating the same of an electronic device are described. One apparatus includes a radio frequency (RF) including a surface-current dispersing circuit and an antenna structure coupled to the RF feed at a feeding point and coupled to a ground plane at a grounding point. The antenna structure comprises an even multiple of quarter-wavelength elements with a first element coupled to the feeding point and a second element coupled to the grounding point and the grounding point is located at a specified distance from the feeding point. Surface currents, generated as a result of the RF signals being applied to the RF feed at the feeding point, create a first hot spot of an even multiple of hot spots of magnetic field at the feeding point. The surface-current dispersing circuit and the ground point disperse a portion of the surface currents at the feeding point towards the grounding point to create other hot spots of the even multiple of hot spots. The even multiple of hot spots are areas of the antenna structure on which surface-current density is higher than on an area surrounding the even multiple of hot spot areas. Hot spots of magnetic field may also be referred to as surface-current hot spot. The embodiments described herein disperse a portion of the surface currents to create additional hotspots, and the remaining portion still creates the first hot spot, but with a smaller magnitude. That is the first hot spot is still created, but has a lower surface-current density because the portion of the surface currents that is dispersed to create additional one or more additional hot spots away from the first hot spot as described herein. For example, the antenna structure includes four quarter-wavelength elements with the first two elements and two additional elements. The surface-current dispersing circuit and the ground point disperse additional portions of the surface currents at the feeding point and the grounding point to create a third hot spot and a fourth hot spot. The third and fourth hot spots are areas of the antenna structure over which surface-current density is higher than other areas surrounding the first, second, third and fourth hot spots.

The antenna structure can be used for Long Term Evolution (LTE) frequency bands, third generation (3G) frequency bands, Wi-Fi® and Bluetooth® frequency bands or other wireless local area network (WLAN) frequency band, wide area network (WAN) frequency bands, global positioning system (GPS) frequency bands, or the like.

The electronic device (also referred to herein as user device) may be any content rendering device that includes a wireless modem for connecting the user device to a network. Examples of such electronic devices include electronic book readers, portable digital assistants, mobile phones, laptop computers, portable media players, tablet computers, cameras, video cameras, netbooks, notebooks, desktop computers, gaming consoles, DVD players, media centers, and the like. The user device may connect to a network to obtain content from a server computing system (e.g., an item providing system) or to perform other activities. The user device may connect to one or more different types of cellular networks.

Figure 2:
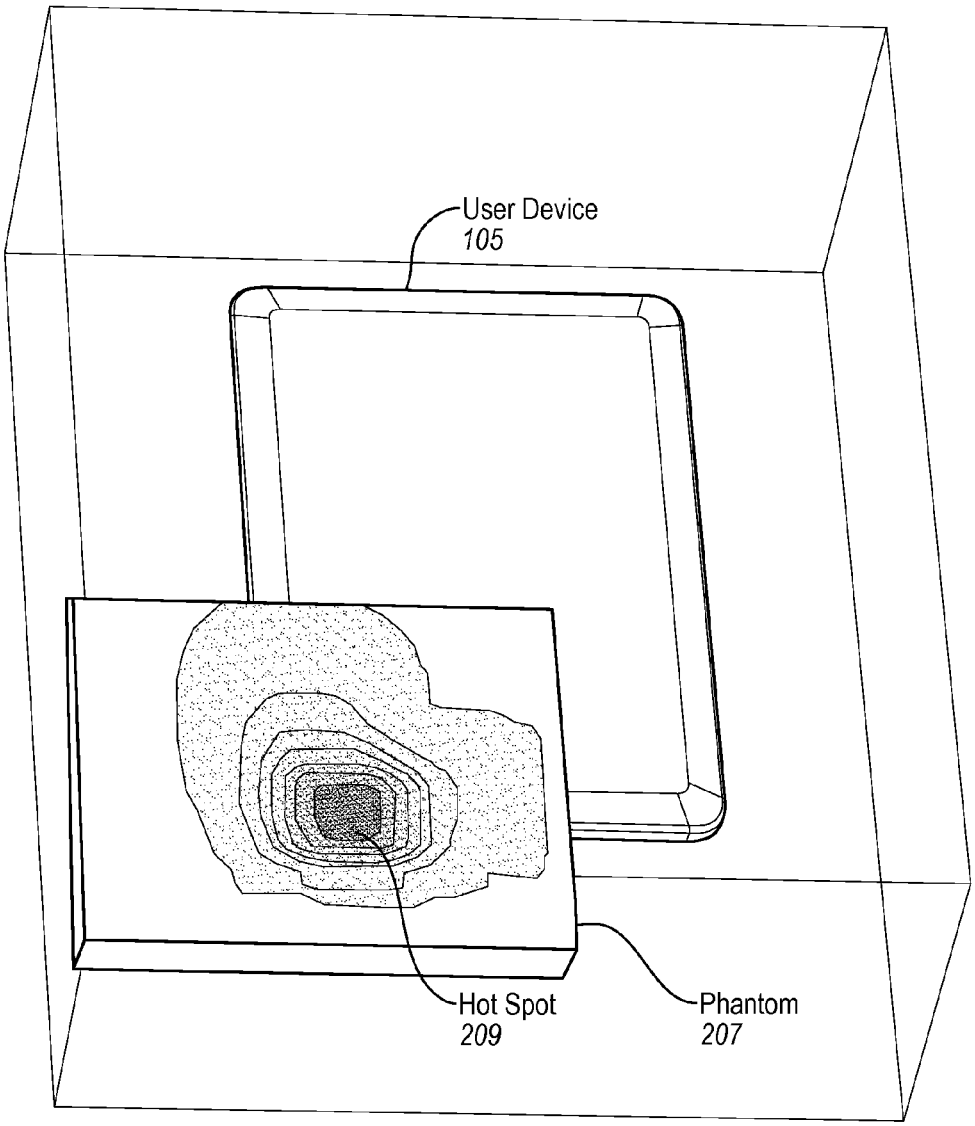
FIG. 2 illustrates a hot spot of magnetic field caused by the monopole antenna structure of FIG. 1 in a phantom according to one implementation.

SAR is dependent on the average power transmitted. Power throttling can be used to back off the average power transmitted to ensure that the device complies with FCC regulations concerning radiation absorbed by human tissue, also referred to as SAR requirements. A procedure known as SAR testing quantifies this absorbed radiation. A SAR number is obtained while testing the device in close proximity to a phantom (e.g., gel) that simulates the RF properties of human tissue while it is transmitting at full power. To comply with FCC regulations, some devices use proximity sensors to sense a proximity to tissue and reduce the power accordingly. The embodiments described herein utilize the antenna structure design and a surface-current dispersing circuit to reduce SAR when the user device is in proximity to a person (e.g., a human body part) or a SAR phantom (hereinafter "phantom") as used during testing of SAR for the user device to comply with FCC regulation. For example, the embodiments described herein can minimize SAR by dispersing a portion of the surface currents at a first hot spot of magnetic field, created at a feeding point, towards a grounding point to create a second hot spot (or additional hot spots of an even multiple as described herein) of magnetic field at a grounding point. The first and second hot spots are areas on the antenna structure on which surface-current density is higher than on an area surrounding the first and second hot spot areas. To illustrate and describe the embodiments below, FIG. 1 illustrates a monopole antenna structure and FIG. 2 shows a single hot spot created by the monopole structure. FIGS. 3-10 illustrate various embodiments of antenna structures and surface-current dispersing circuits to create multiple hot spots by dispersing some of the surface currents to reduce SAR caused by a user device.

FIG. 1 is a rear view of a user device 105 and a close-up view of a monopole antenna structure 100 according to one implementation. In this implementation, the antenna structure 100 includes a monopole element 102 disposed in relation to a ground plane 140. The ground plane 140 may be a metal frame of the user device 105, such as a system ground or one of multiple grounds of the user device 105. A RF feed 142 of the user device 105 carries RF signals to and/or from the antenna structure 100 and the circuitry of the user device 105. The user device 105 may also include an impedance matching network including a capacitor 103 (e.g., 1.4 pF) coupled in series between the RF feed 142 and the monopole element 102 and an inductor 105 (e.g., 25 nH) coupled in parallel between the monopole element 102 and the ground plane 140. An antenna area of the antenna structure 100 is approximately 9.9 millimeters (mm) in height ($h_1$) and 21.5 mm in width ($W_1$). The monopole element 102 has an L shape, including a first portion that extends from the RF feed 142 in a first direction towards a first junction and a second portion that extends from the first junction in a second direction that is perpendicular to the first direction. An end of the monopole element 102 is not grounded to the ground plane 140.

During operation, the RF feed 142 applies current to the monopole element 102 and the monopole element 102 radiates magnetic field. As shown in FIG. 2, the monopole element 102 creates a hot spot of magnetic field. The hot spot is an area of the monopole element 102 that has a higher surface-current density than other surrounding areas of the monopole element 102.

FIG. 2 illustrates a hot spot of magnetic field 209 caused by the monopole antenna structure of FIG. 1 in a phantom 207 according to one implementation. The hot spot 209 has a higher surface-current density than areas surrounding the hot spot 209. The surface-current density decreases as a function of distance away from a center area of the hot spot 209.

For some SAR tests, the user device 105 needs to be tested at 0 mm distance between the user device 105 and the phantom 207 and result in a SAR value lower than 1.6 w/kg at 2.44 GHz with nominal RF power (e.g., 13 dBm or 0.02 Watts) in a slant position. The antenna structure 100, illustrated in FIG. 1, results in 1.7 w/kg at 2.44 GHz, above the FCC limit with 13 dBm accepted power). At 2.67 GHz, the antenna structure 100 results in 2.2 SAR value. At 2.24 GHz, the antenna structure 100 results in 1.4 SAR value. These tests also assume that the distance from the area of the RF feed 142 to the back of the user device 105 is less than 4.3 mm.

Figure 4:
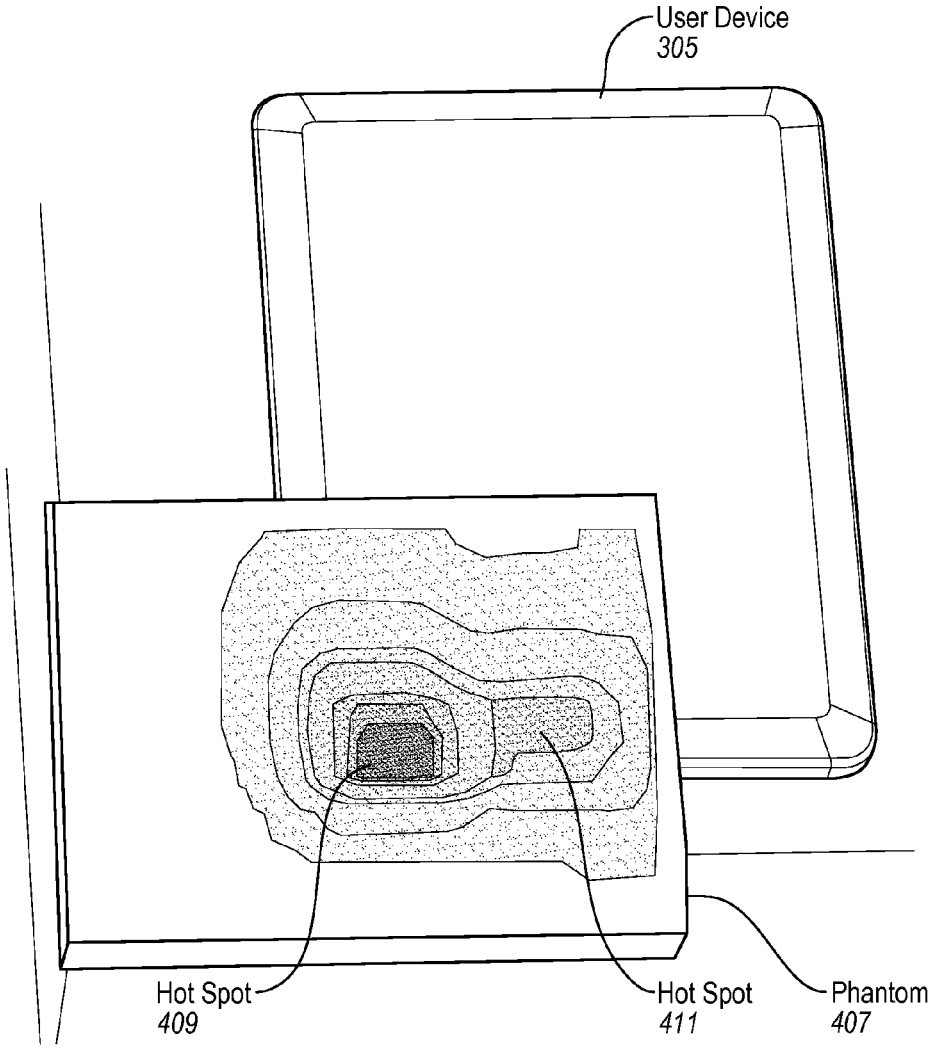
FIG. 4 illustrates two hot spots of magnetic field caused by the antenna structure of FIG. 3 in a phantom according to one embodiment.

The embodiments described herein reduce an antenna's SAR value. For example, FIG. 4 illustrates a folded monopole antenna with a surface-current dispersing circuit, which can substantially reduce the antenna's SAR value. For example, more than 100% SAR reduction can be achieved. The folded monopole antenna and surface-current dispersing circuit of FIG. 2 can be used to meet the SAR requirement described above where SAR is tested at 0 mm distance between the user device and the phantom. In particular, the folded monopole antenna and surface-current dispersing circuit of FIG. 2 can result in a SAR value lower than 1.6 w/kg at 2.44 GHz with nominal RF power (e.g., 13 dBm or 0.02 Watts) in a slant position. The reduced SAR value can allow the antenna structure to operate a higher transmit power, resulting in better communication coverage. The higher transmit power and better communication coverage can result in a better user experience of the user device.

Figure 3:
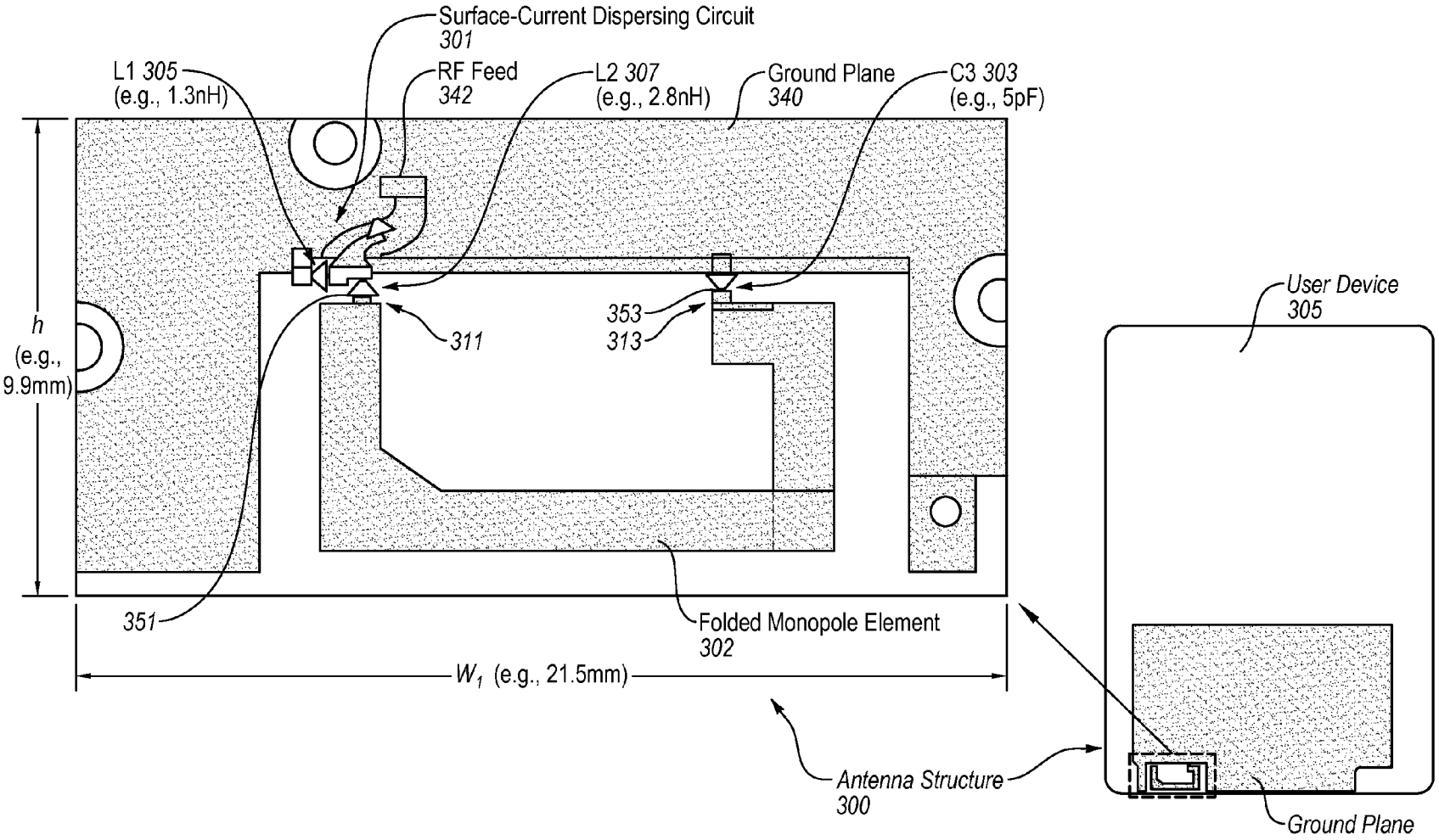
FIG. 3 is a rear view of a user device and a close-up view of an antenna structure and a surface-current dispersing circuit according to one embodiment.
Figure 12:
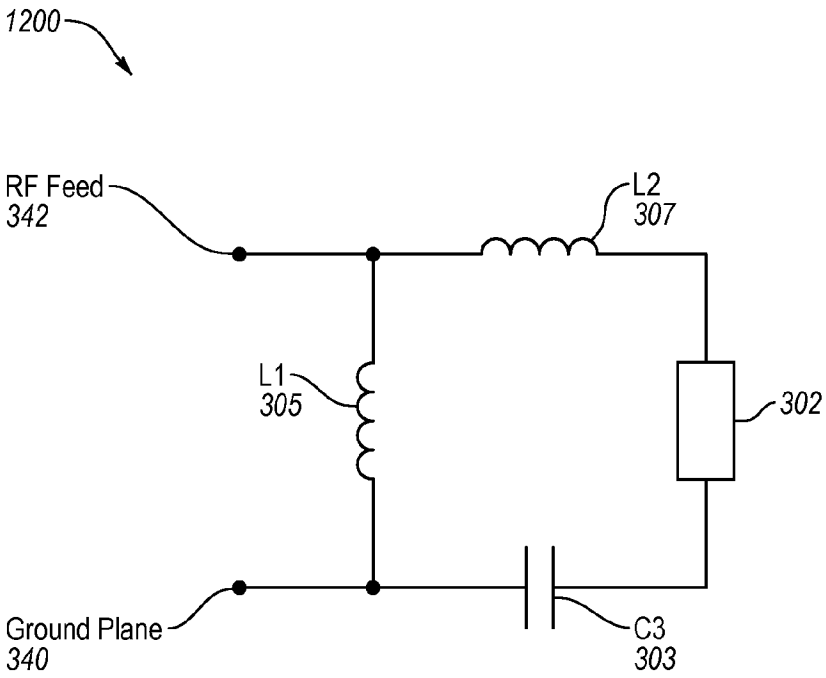
FIG. 12 is an equivalent circuit diagram of the surface-current dispersing circuit of FIG. 3 according to one embodiment.

FIG. 3 is a rear view of a user device 305 and a close-up view of an antenna structure 300 and a surface-current dispersing circuit 301 according to one embodiment. The antenna structure 300 includes a folded monopole element 302 disposed in relation to a ground plane 340. The folded monopole element 302 is made up of two monopoles folded together. The folded monopole element 302 is coupled to the RF feed 342 at a feeding point 351 at a near end 311 of the folded monopole element 302 and coupled to the ground plane 340 at a grounding point 353 at a far end 313 of the folded monopole element 302. The folded monopole element 302 is fed at a left side of a rear view of the user device 305. The ground plane 340 may be a metal frame of the user device 305, such as a system ground or one of multiple grounds of the user device 305. A RF feed 342 of the user device 305 carries RF signals to and/or from the antenna structure 300 and the circuitry of the user device 305. The surface-current dispersing circuit 301 includes a first inductive element (L1) 305 coupled in series between the RF feed 342 and the feeding point 351 at the near end 311, a second inductive element (L2) 307 coupled in parallel between the feeding point 351 and the ground plane 340, and a first capacitive element (C3) 303 coupled in series between the ground plane 340 and the grounding point 353 at the distal end 313. FIG. 12 is an equivalent circuit diagram 1200 of the surface-current dispersing circuit 301 of FIG. 3 according to one embodiment. In one embodiment, L1 305 is 1.3 nH, L2 307 is 2.8 nH, and C3 303 (5 pF). The first inductive element (L1) 305 is a first conductive strip with a first inductance, the second inductive element (L2) 307 is a second conductive strip with a second inductance and the first capacitive element (C3) 303 is a third conductive strip with a first capacitance. In another embodiment, the first inductive element, the second inductive element and the first capacitive element are discrete components. In another embodiment, the user device 305 may include other components in an impedance matching network. In another embodiment, the impedance matching can be incorporated into the selection of components used for the surface-current dispersing circuit 301.

An antenna area of the antenna structure 300 is the same as the antenna area of antenna structure 100. In particular, the antenna area is approximately 9.9 millimeters (mm) in height ($h_1$) and 21.5 mm in width ($W_1$).

In the depicted embodiment, the antenna structure 300 includes a first arm portion that extends from the feeding point 351 to a first junction in a first direction, a second arm portion that extends from the first junction in a second direction towards a second junction; a third arm portion that extends from the second junction in a third direction towards a third junction; and a fourth arm portion that extends from the third junction in a fourth direction towards a fourth junction. The fourth arm portion is coupled to the grounding point at an opposite end from the third junction. In this embodiment, the fourth arm portion is parallel to the ground plane and coupled to the grounding point 353 at an opposite end of the third junction and the third direction is parallel to the first direction and the fourth direction is parallel to the second direction. It should be noted that a "junction" or "fold" refers to a bend, a corner or other change in direction of the antenna element. For example, the junction may be where one segment of an antenna element changes direction in the same plane or in a different plane. Typically, junctions or folds in antennas can be used to fit the entire length of the antenna within a smaller area or smaller volume of a user device. The antenna structure 300 can be formed by using one or more conductive traces on a printed circuit board, metal traces disposed on the antenna carrier, or the like.

In another embodiment, the folded monopole element 302 has a first monopole element having an L-shape coupled to the feeding point 351 and a second monopole element having an L-shape coupled to the grounding point 353. The first monopole element and the second monopole element together form a U-shape with a first end of the U-shape coupled to the feeding point 351 and a second end of the U-shape coupled to the grounding point 353. In one embodiment, a perimeter of the U-shape is equal to half wavelength of the folded monopole element 302. The grounding point 353 is located at a specified distance from the feeding point 351. In the depicted embodiment, the specified distance is at least ten millimeters.

The antenna structure 300 can be disposed in a user device 305 that includes circuitry that drives an RF feed 342. The antenna structure 300, unlike antenna structure 100, is coupled to the ground plane 340 at a grounding point 353. In FIG. 3, the ground is represented as a radiation ground plane 340. The ground plane 340 may be a metal frame of the user device 305. The ground plane 340 may be a system ground or one of multiple grounds of the user device 305. The RF feed 342 may be a feed line connector that couples the antenna structure 300 to a respective transmission line of the user device 305. The RF feed 342 is a physical connection that carries the RF signals to and/or from the antenna structure 300 and the circuitry of the user device 305. The feed line connector may be any one of the three common types of feed lines, including coaxial feed lines, twin-lead lines or waveguides. A waveguide, in particular, is a hollow metallic conductor with a circular or square cross-section, in which the RF signal travels along the inside of the hollow metallic conductor. Alternatively, other types of connectors can be used. In the depicted embodiment, the RF feed 342 includes the surface-current dispersing circuit 301. It should be noted that the surface-current dispersing circuit 301 includes one or more components disposed at the RF feed 342 and one or more components disposed at the grounding point 353. The surface-current dispersing circuit 301 is directly connected to the folded monopole element 302. In another embodiment, the feed line connection is connected to the antenna structure with one or more impedance matching networks in addition to the surface-current dispersing circuit 301. Alternatively, the surface-current dispersing circuit 301 can be used to optimize the surface currents and to impedance match.

In one embodiment, antenna structure 300 is disposed on an antenna carrier (not illustrated), such as a dielectric carrier of the user device 305. The antenna carrier may be any non-conductive material, such as dielectric material, upon which the conductive material of the antenna structure 300 can be disposed without making electrical contact with other metal of the user device. In another embodiment, the antenna structure 300 is disposed on, within, or in connection with a circuit board, such as a printed circuit board (PCB). In one embodiment, the ground plane 340 may be a metal chassis of a circuit board. Alternatively, the antenna structure 300 may be disposed on other components of the user device or within the user device (or of or within other electronic devices). It should be noted that the antenna structure 300 illustrated in FIG. 3 is a two-dimensional (2D) structure. However, as described herein, antenna structure 300 may include three-dimensional (3D) structures, as well as other variations than those depicted in FIG. 3. The antenna structure 300 is designed to fit in a smaller volume or area (e.g., 9.9 mm×21.5 mm) while maintaining the overall length of the antenna elements. The embodiments of the antenna structure 300 can be used in compact devices with space constraints. For example, in one embodiment, the antenna structure 300 fits within an area of 9.9 mm height (h1) and 21.5 mm width (w1). This area can still accommodate additional components of the user device. In other embodiments, smaller or larger areas or volumes can be used.

The dimensions of the antenna structure 300 may be varied to achieve the desired frequency range as would be appreciated by one of ordinary skill in the art having the benefit of this disclosure, however, the total length of the antennas is a major factor for determining the frequency, and the width of the antennas is a factor for impedance matching. It should be noted that the factors of total length and width are dependent on one another. The antenna structure 300 may have various dimensions based on the various design factors. The folded monopole element 302 has an effective length that is roughly the distance between the feeding point 351 along the conductive trace(s) to the grounding point 353. Of course, other variations of layout and shapes may be used for the antenna structure 300. For example, the antenna structure 300 can have various bends, such as to accommodate placement of other components, such as a speakers, microphones, USB ports.

During operation, the RF feed 342 applies current to the folded monopole element 302 and the folded monopole element 302 radiates magnetic field in response. As shown in FIG. 4, the folded monopole element 302 creates two hot spot of magnetic field. The hot spots are areas of the folded monopole element 302 that has a higher surface-current density than on other areas surrounding the hot spot areas of the folded monopole element 302. The folded monopole element 302 radiates magnetic field in a resonant mode when the RF signals in a frequency range are applied to the RF feed 342. In one embodiment, the frequency range is centered at approximately 2.44 GHz. In another embodiment, the frequency range is centered at approximately 5.5 GHz. The embodiments described herein are not limited to use in these frequency ranges, but could be used in one or more frequency bands or frequency ranges, as described herein. The antenna structure 300 may be configured to operate in multiple resonant modes. For example, in another embodiment, the antenna structure may include one or more additional arm elements, slot antennas in the antenna structure or notches to create one or more additional resonant modes. In another embodiment, the antenna structure may include additional elements, such as a parasitic ground element (e.g., a monopole that extends from the ground plane that closely couples to the other antenna elements), to create an additional resonant mode. For example, the antenna structure 300 can be used in wireless local area network (WLAN) frequency bands. Alternatively, the antenna structure 300 can be used in one or more of the following frequency bands Long Term Evolution (LTE) 700 (band 17), 1800 (band 3), 2600 (band 7), etc., Universal Mobile Telecommunications System (UMTS) (also referred to as Wideband Code Division Multiple Access (WCDMA)) and Global System for Mobile Communications (GSM) 850, GSM 900, GSM 1800 (also referred to as Digital Cellular Service (DCS) 1800) and GSM 1900 (also referred to as Personal Communication Service (PCS) 1900). The antenna structure 300 may be configured to operate in multiple resonant modes. References to operating in one or more resonant modes indicates that the characteristics of the antenna structure, such as length, position, width, proximity to other elements, ground, or the like, decrease a reflection coefficient at certain frequencies to create the one or more resonant modes as would be appreciated by one of ordinary skill in the art. Also, some of these characteristics can be modified to tune the frequency response at those resonant modes, such as to extend the bandwidth, decrease the reflection coefficient, or the like. The embodiments described herein also provide an antenna structure in a size that is conducive to being used in a compact user device.

FIG. 4 illustrates two hot spots of magnetic field 409, 411, caused by the antenna structure of FIG. 3 in a phantom 407 according to one embodiment. The hot spots 409, 411 have higher surface-current density than areas surrounding hot spot 409, 411. Instead of the surface-current density decreasing as a function of distance away from a center area of one hot spot, the surface-current density of the first hot spot 409 disperses from the first hot spot 409 towards the grounding point 353 to create the second hot spot 411. The first hot spot 409 is located at the feeding point 351 and the second hot spot 411 is located at the grounding point 353. The surface-current density of the first hot spot 409 is higher than the second hot spot 411. The creation of the second hot spot 411 reduces the surface-current density of the first hot spot 409 at the feeding point 351. The antenna structure 300 has two launch points effectively. One launch point is the feeding point 351 of the RF feed 342 and the other launch point is the grounding point 353 where the folded monopole element 302 is coupled to the ground plane 340. The two launch points result in two hot spots 409, 411. Grounding the folded monopole element 302 at the grounding point 353 (at a specified distance away from the feeding point 351) may disperse a portion of the surface currents between the two hot spots 409, 411, reducing the overall SAR value within any given 1 g tissue volume (ten by ten by ten millimeter (10×10×10 mm) volume within the antenna area.

As described above, for some SAR tests, the user device 305 needs to be tested at 0 mm distance between the user device 305 and the phantom 407 and result in a SAR value lower than 1.6 w/kg at 2.44 GHz with nominal RF power (e.g., 13 dBm or 0.02 Watts) in a slant position. The antenna structure 300, illustrated in FIG. 3, results in 0.8 mw/g (also represented as 0.8 w/kg) at 2.44 GHz, below the FCC limit with 13 dBm accepted power). At 2.67 GHz, the antenna structure 300 results in 1.0 SAR value. At 2.24 GHz, the antenna structure 300 results in 0.7 SAR value. These tests also assume that the distance from the area of the RF feed 342 to the back of the user device 305 is less than 4.3 mm.

The antenna structure 300 reduces an antenna's SAR value, as compared to the antenna structure 100 within the same antenna area. For example, the antenna structure 300 can achieve 100% SAR reduction as compared to the antenna structure 100. The folded monopole antenna 302 and surface-current dispersing circuit 301 of FIG. 3 can be used to meet the SAR requirement described above where SAR is tested at 0 mm distance between the user device 305 and the phantom 407. In particular, the folded monopole antenna 302 and surface-current dispersing circuit 301 of FIG. 3 can result in a SAR value lower than 1.6 w/kg at 2.44 GHz with nominal RF power in a slant position. The reduced SAR value can allow the antenna structure 300 to operate a higher transmit power, resulting in better communication coverage. The higher transmit power and better communication coverage can result in a better user experience of the user device.

Figure 5:
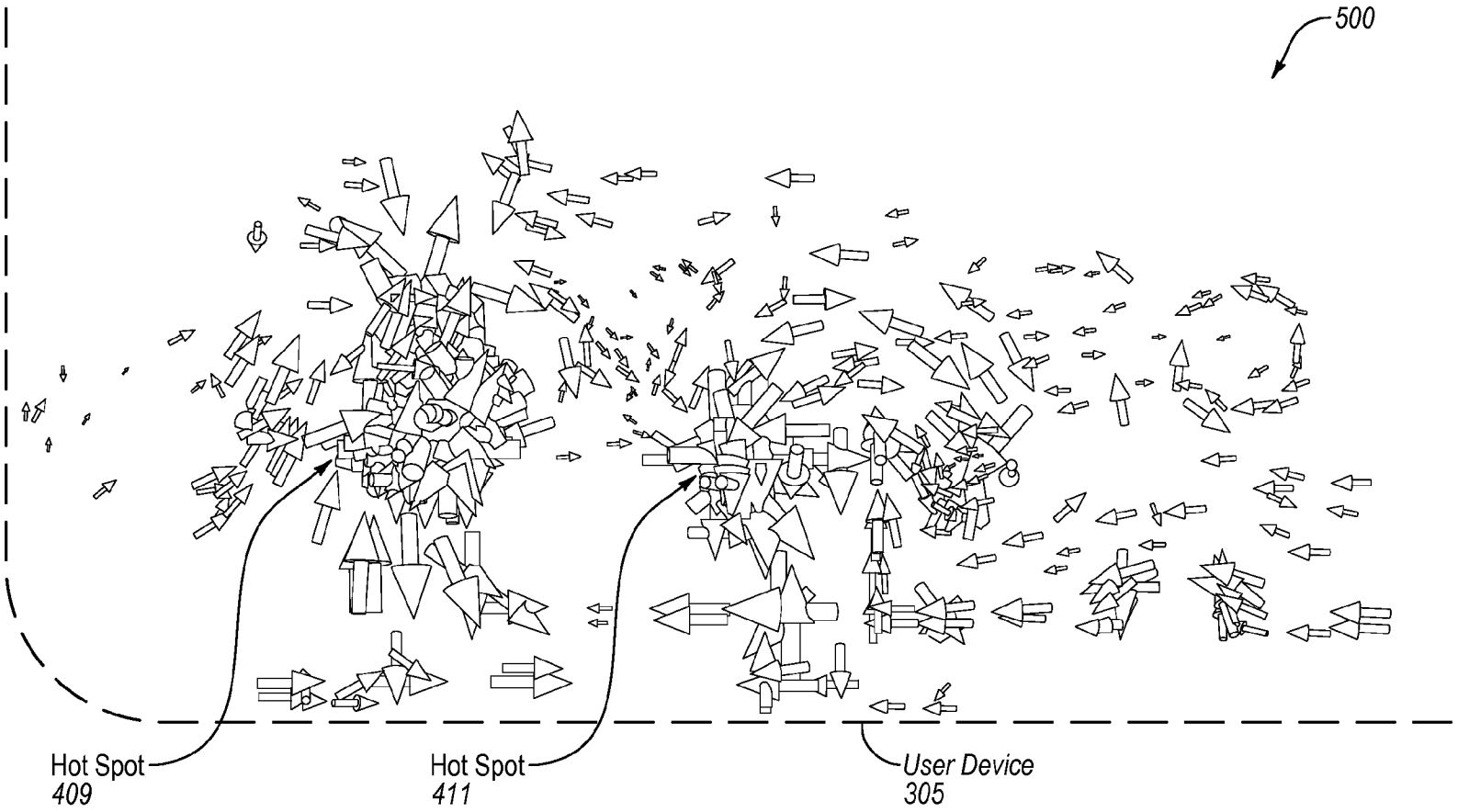
FIG. 5 illustrates surface current flows of the two hot spots of FIG. 4 according to one embodiment.

FIG. 5 illustrates surface current flows 500 of the two hot spots of FIG. 4 according to one embodiment. In order to distinguish between surface currents of antenna structure 100 and 300, a vector surface current distribution of antenna structure 300 at 2.44 GHz is plotted in FIG. 5. It can be seen from FIG. 5 that a resonant mode at 2.44 GHz are a folded monopole element, including two quarter-wavelength monopole elements (2×¼λ(0.5λ)). In other embodiments, other antenna elements can be used, such as a folded dipole structure, a folded loop structure, or the like. The two monopole elements operate as "head to tail and tail to head" manner By further examining the surface current distribution at the frequency of 2.44 GHz illustrated in FIG. 5, there are two ¼ λ monopoles which connect at their minimum current regions via the "head to tail and tail to head" manner. The two ¼ λ monopoles create two hot spots 409, 411 illustrated in FIGS. 5.

Figure 6:
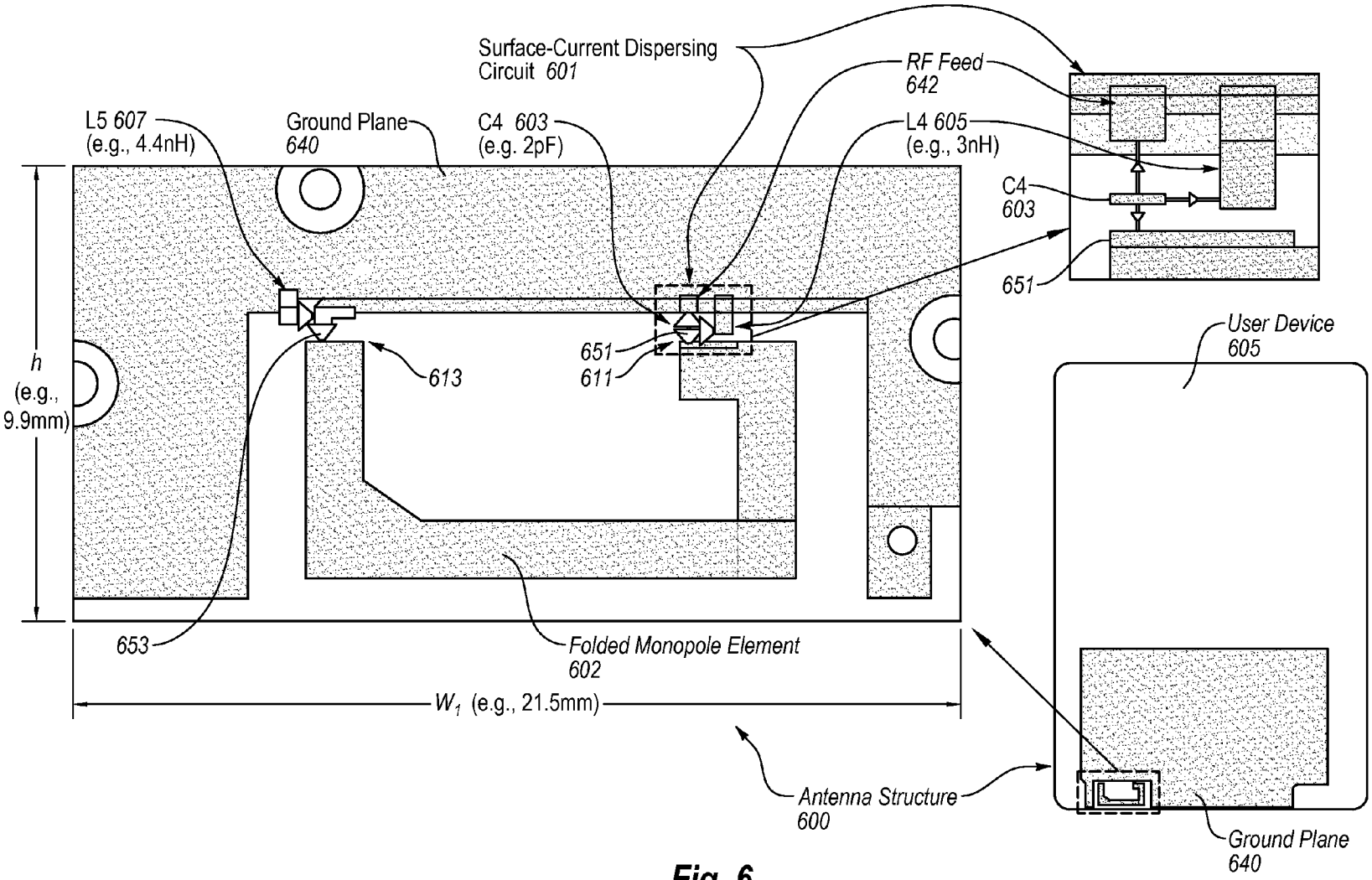
FIG. 6 is a rear view of a user device and a close-up view of another antenna structure and a surface-current dispersing circuit according to one embodiment.
Figure 13:
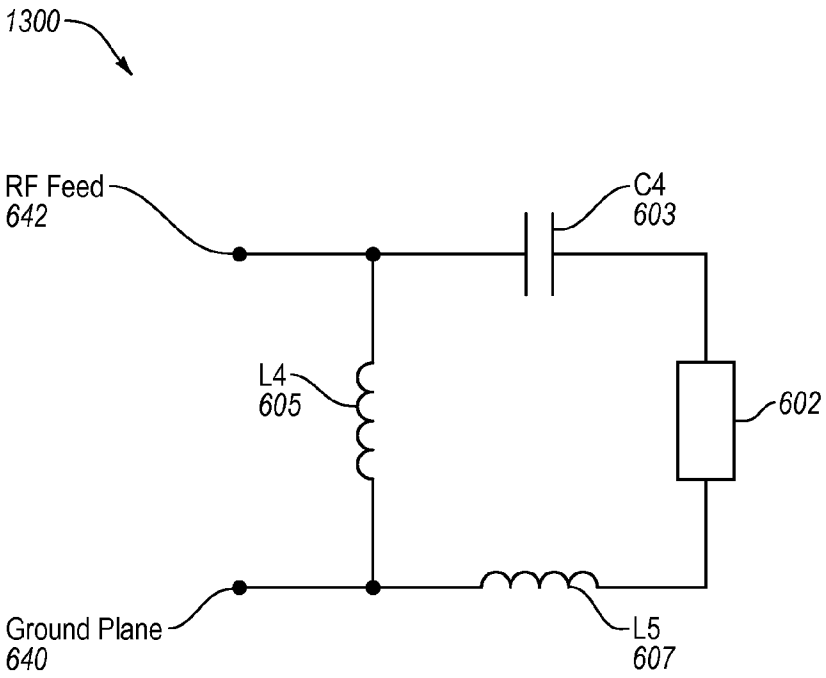
FIG. 13 is an equivalent circuit diagram of the surface-current dispersing circuit of FIG. 6 according to another embodiment.

FIG. 6 is a rear view of a user device 605 and a close-up view of another antenna structure 600 and a surface-current dispersing circuit 601 according to one embodiment. The antenna structure 600 includes a folded monopole element 602 disposed in relation to a ground plane 640. The folded monopole element 602 is made up of two monopoles folded together. The folded monopole element 602 is coupled to the RF feed 642 at a feeding point 651 at a near end 611 of the folded monopole element 602 and coupled to the ground plane 640 at a grounding point 653 at a far end 613 of the folded monopole element 602. The folded monopole element 602 is fed at a right side of a rear view of the user device 605. The ground plane 640 may be similar to the ground plane 340. A RF feed 642 of the user device 605 carries RF signals to and/or from the antenna structure 600 and the circuitry of the user device 605. The surface-current dispersing circuit 601 includes a first capacitive element (C4) 603 coupled in series between the RF feed 642 and the feeding point 651 at the near end 611, a first inductive element (L4) 605 coupled in parallel between the feeding point 651 and the ground plane 640, and a second inductive element (L5) 607 coupled in series between the ground plane 640 and the grounding point 653 at the distal end 613. FIG. 13 is an equivalent circuit diagram 1300 of the surface-current dispersing circuit 601 of FIG. 6 according to one embodiment. In one embodiment, C4 605 is 2 pF, L4 605 is 3 nH, and L5 607 is 4.4 nH. In one embodiment, the first capacitive element (C4) 603 is a first conductive strip with a first capacitance, the first inductive element (L4) 605 is a second conductive strip with a first inductance and the second inductive element (L5) 607 is a third conductive strip with a second inductance. In another embodiment, the first capacitive element 603, the first inductive element 605 and the second capacitive element 607 are discrete components. In another embodiment, the user device 605 may include other components in an impedance matching network. In another embodiment, the impedance matching can be incorporated into the selection of components used for the surface-current dispersing circuit 601.

An antenna area of the antenna structure 300 is the same as the antenna area of antenna structure 300. In particular, the antenna area is approximately 9.99 millimeters (mm) in height ($h_1$) and 21.5 mm in width ($W_1$).

In the depicted embodiment, the antenna structure 600 includes a first arm portion that extends parallel to the ground plane 640 in a first direction towards a first junction. The first arm portion is coupled to the feeding point 651 at an opposite end from the first junction. A second arm portion extends from the first junction in a second direction towards a second junction. A third arm portion extends from the second junction in a third direction towards a third junction and a fourth arm portion extends from the third junction in a fourth direction towards the grounding point 653. The fourth arm portion is coupled to the grounding point 653 at an opposite end from the third junction. The third direction is parallel to the first direction and the fourth direction is parallel to the second direction. The antenna structure 600 can be formed by using one or more conductive traces on a printed circuit board, metal traces disposed on the antenna carrier, or the like.

In another embodiment, the folded monopole element 602 has a first monopole element having an L-shape coupled to the feeding point 651 and a second monopole element having an L-shape coupled to the grounding point 653. The first monopole element and the second monopole element together form a U-shape with a first end of the U-shape coupled to the feeding point 651 and a second end of the U-shape coupled to the grounding point 653. In one embodiment, a perimeter of the U-shape is equal to half wavelength of the folded monopole element 602. The grounding point 653 is located at a specified distance from the feeding point 651. In the depicted embodiment, the specified distance is at least ten millimeters. The ground plane 640 is similar to the ground plane 340 as described above. The RF feed 640 is similar to the RF feed 340 as described above. In the depicted embodiment, the RF feed 642 includes the surface-current dispersing circuit 601. It should be noted that the surface-current dispersing circuit 601 includes one or more components disposed at the RF feed 642 and one or more components disposed at the grounding point 653. The surface-current dispersing circuit 601 is directly connected to the folded monopole element 602. In another embodiment, the feed line connection is connected to the antenna structure 600 with one or more impedance matching networks in addition to the surface-current dispersing circuit 601. Alternatively, the surface-current dispersing circuit 601 can be used to optimize the surface currents and to impedance match.

In one embodiment, antenna structure 600 is disposed on an antenna carrier as described above. In another embodiment, the antenna structure 600 is disposed on, within, or in connection with a circuit board, such as a PCB. In one embodiment, the ground plane 640 may be a metal chassis of a circuit board. Alternatively, the antenna structure 600 may be disposed on other components of the user device 605 or within the user device 605 (or of or within other electronic devices). It should be noted that the antenna structure 600 illustrated in FIG. 6 is a 2D structure, but could be a 3D structure as described herein. The antenna structure 600 can also fit in a smaller volume or area while maintaining the overall length of the antenna elements. The embodiments of the antenna structure 600 can be used in compact devices with space constraints. For example, in one embodiment, the antenna structure 300 fits within an area of 9.9 mm height (h1) and 21.5 mm width (w1). This area can still accommodate additional components of the user device 605. In other embodiments, smaller or larger areas or volumes can be used. The dimensions of the antenna structure 600 may be varied to achieve the desired frequency range. The antenna structure 600 may have various dimensions and shapes based on the various design factors. The folded monopole element 602 has an effective length that is roughly the distance between the feeding point 651 along the conductive trace(s) to the grounding point 653. Of course, other variations of layout and shapes may be used for the antenna structure 600. For example, the antenna structure 600 can have various bends, such as to accommodate placement of other components, such as a speakers, microphones, USB ports.

Figure 7:
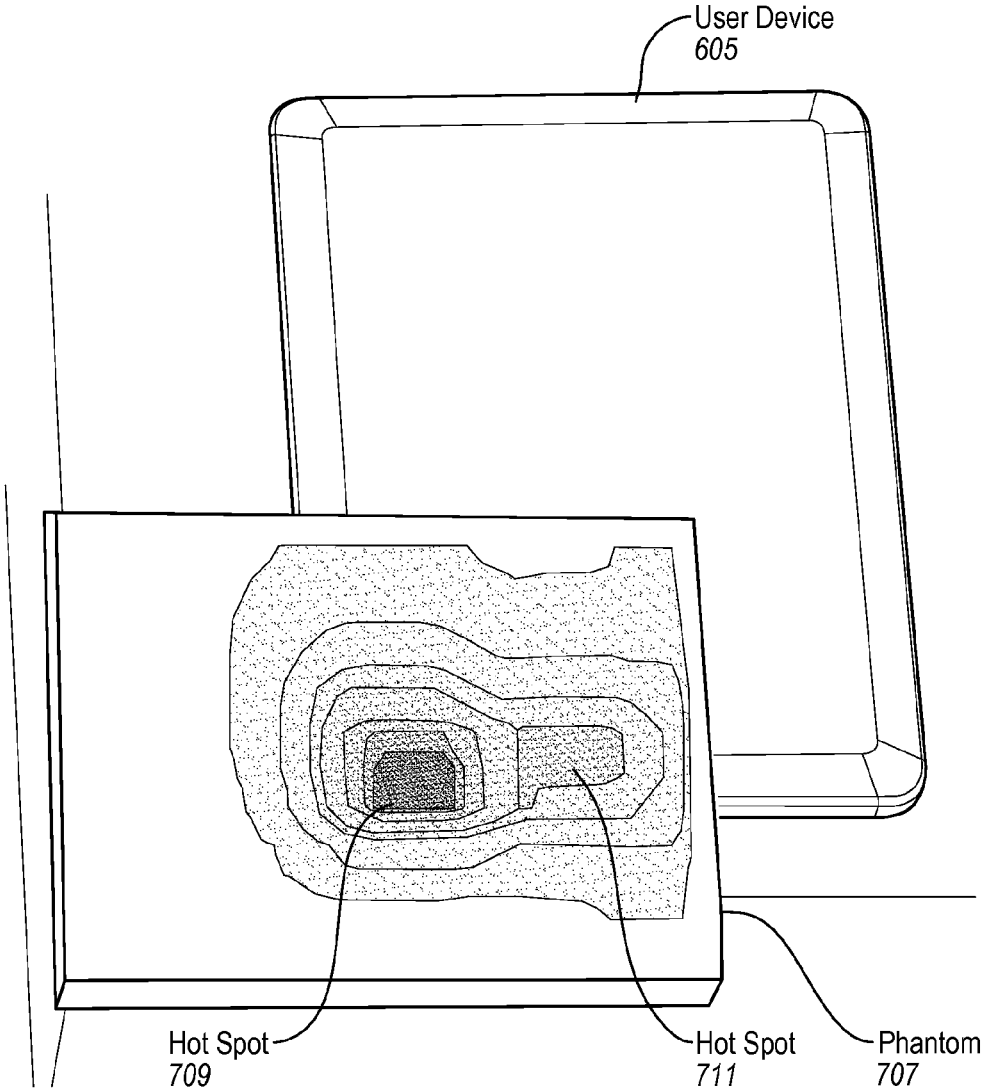
FIG. 7 illustrates two hot spots of magnetic field caused by the antenna structure of FIG. 6 in a phantom according to one embodiment.

During operation, the RF feed 642 applies current to the folded monopole element 602 and the folded monopole element 602 radiates magnetic field in response. As shown in FIG. 7, the folded monopole element 602 creates two hot spot of magnetic field. The hot spots are areas of the folded monopole element 602 on which there is higher surface-current density than other areas surrounding the hot spot areas of the folded monopole element 602. The folded monopole element 602 radiates magnetic field in a resonant mode when the RF signals in a frequency range are applied to the RF feed 642. In one embodiment, the frequency range is centered at approximately 2.44 GHz. In another embodiment, the frequency range is centered at approximately 5.5 GHz. The embodiments described herein are not limited to use in these frequency ranges, but could be used in one or more frequency bands or frequency ranges, as described herein.

FIG. 7 illustrates two hot spots of magnetic field 709, 711 caused by the antenna structure of FIG. 6 in a phantom 707 according to one embodiment. The hot spots 709, 711 have higher surface-current density than areas surrounding the hot spot 709, 711. Instead of the surface-current density decreasing as a function of distance away from a center area of one hot spot, the surface-current density of the first hot spot 709 disperses from the first hot spot 709 towards the grounding point 653 to create the second hot spot 711. The first hot spot 709 is located at the feeding point 651 and the second hot spot 711 is located at the grounding point 653. The surface-current density of the first hot spot 709 is higher than the second hot spot 711. The creation of the second hot spot 711 reduces the surface-current density of the first hot spot 709 at the feeding point 651. The antenna structure 600 has two launch points effectively. One launch point is the feeding point 651 of the RF feed 642 and the other launch point is the grounding point 653 where the folded monopole element 602 is coupled to the ground plane 640. The two launch points result in two hot spots 709, 711. Grounding the folded monopole element 602 at the grounding point 653 (at a specified distance away from the feeding point 651) may disperse a portion of the surface currents between the two hot spots 709, 711, reducing the overall SAR value within any given ten by ten millimeter (10×10 mm) area within the antenna area.

As described above, for some SAR tests, the user device 605 needs to be tested at 0 mm distance between the user device 605 and the phantom 707 and result in a SAR value lower than 1.6 w/kg at 2.44 GHz with nominal RF power (e.g., 13 dBm or 0.02 Watts) in a slant position. The antenna structure 600, illustrated in FIG. 6, results in 0.8 mw/g (also represented as 0.8 w/kg) at 2.44 GHz, below the FCC limit with 13 dBm accepted power). At 2.67 GHz, the antenna structure 600 results in 1.1 SAR value. At 2.24 GHz, the antenna structure 600 results in 0.7 SAR value. These tests also assume that the distance from the area of the RF feed 642 to the back of the user device 605 is less than 4.3 mm.

The antenna structure 600 reduces an antenna's SAR value, as compared to the antenna structure 100 within the same antenna area. For example, the antenna structure 600 can achieve over 100% SAR reduction as compared to the antenna structure 100. The folded monopole antenna 602 and surface-current dispersing circuit 601 of FIG. 6 can be used to meet the SAR requirement described above where SAR is tested at 0 mm distance between the user device 605 and the phantom 707. In particular, the folded monopole antenna 602 and surface-current dispersing circuit 601 of FIG. 6 can result in a SAR value lower than 1.6 w/kg at 2.44 GHz with nominal RF power in a slant position. The reduced SAR value can allow the antenna structure 600 to operate a higher transmit power, resulting in better communication coverage. The higher transmit power and better communication coverage can result in a better user experience of the user device.

Figure 8:
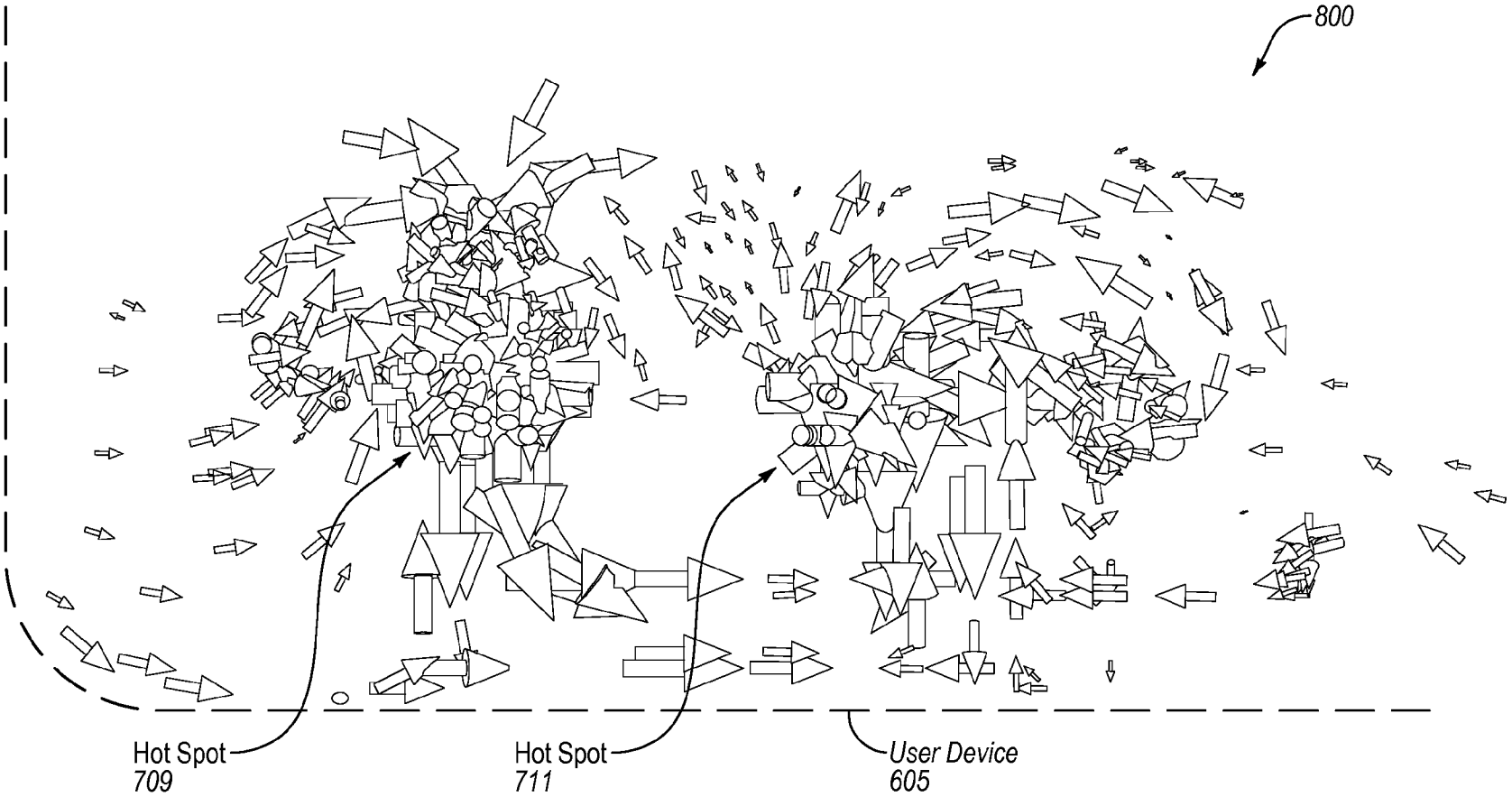
FIG. 8 illustrates surface current flows of the two hot spots of FIG. 7 according to one embodiment.

FIG. 8 illustrates surface currents of the two hot spots of FIG. 7 according to one embodiment. In order to distinguish between surface currents of antenna structure 100 and 600, a vector surface current distribution of antenna structure 600 at 2.44 GHz is plotted in FIG. 8. It can be seen from FIG. 8 that a resonant mode at 2.44 GHz are a folded monopole element, including two quarter-wavelength monopole elements ($2\times\frac{1}{4}\lambda$ ($0.5\lambda$)). In other embodiments, other antenna elements can be used, such as a folded dipole structure, a folded loop structure, or the like. The two monopole elements operate as "head to tail and tail to head" manner.

By further examining the surface current distribution at the frequency of 2.44 GHz illustrated in FIG. 8, there are two $\frac{1}{4}\lambda$ monopoles which connect at their minimum current regions via the "head to tail and tail to head" manner. The two $\frac{1}{4}\lambda$ monopoles create two hot spots 709, 711 illustrated in FIG. 8.

Figure 9:
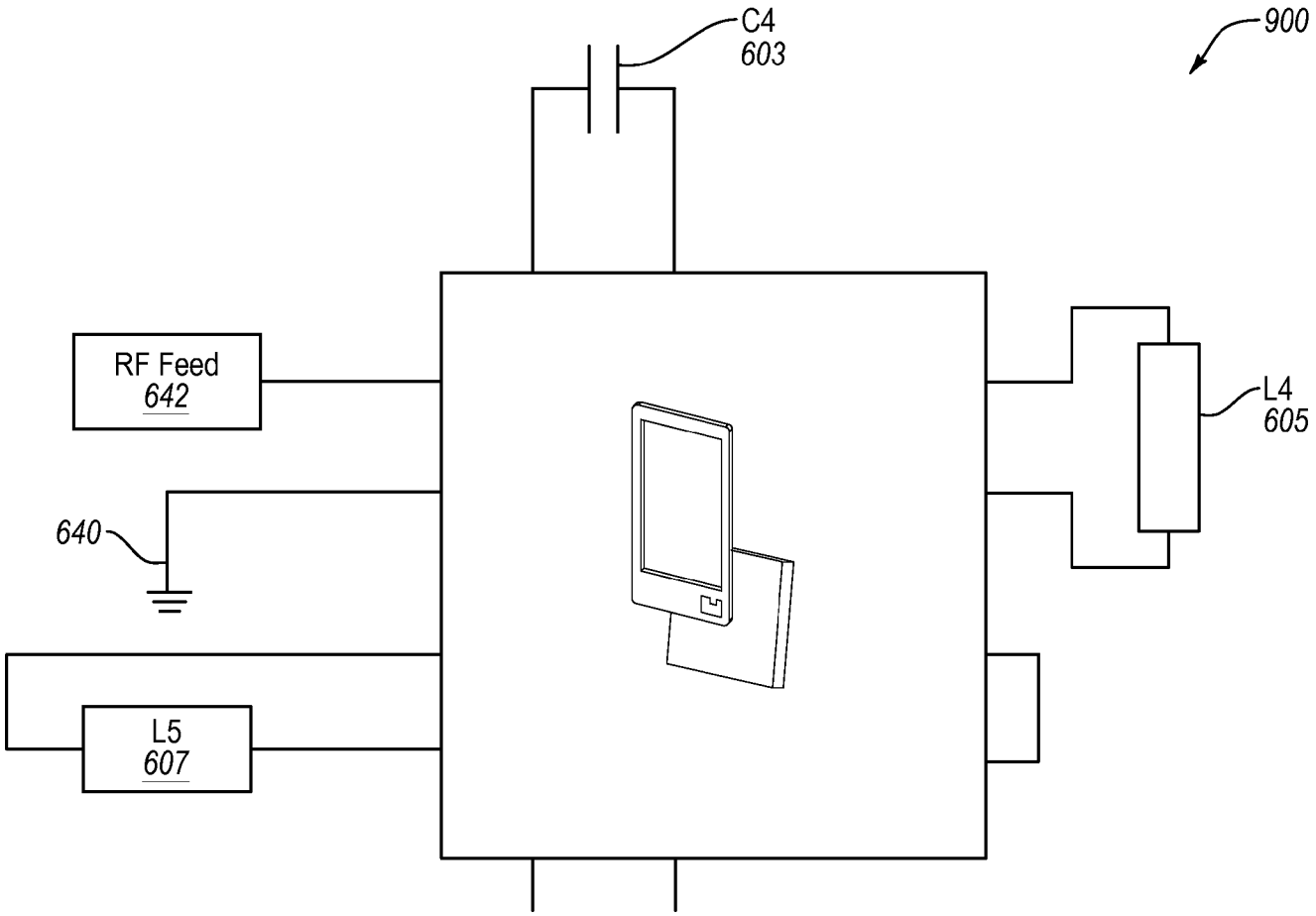
FIG. 9 is a schematic diagram of the surface-current dispersing circuit according to one embodiment.

FIG. 9 is a schematic diagram of the surface-current dispersing circuit 900 according to one embodiment. The surface-current dispersing circuit 900 includes the first capacitive element (C4) 603, a first inductive element (L4) 605, and a second inductive element (L5) 607. An antenna structure, such as antenna structure 600, is coupled to the RF feed 642 and ground plane 640. The components can be coupled in different combinations of series or parallel components as described herein. For example, the surface-current dispersing circuit 900 includes the first inductive element (L1) 305, a second inductive element (L2) 307, and a first capacitive element (C3) 303. The capacitance and inductance elements can be coupled in parallel to the load, coupled in series, or any combination thereof.

In one embodiment, an electronic device includes a transceiver to transmit or receive RF signals, a RF feed coupled to the transceiver, and an antenna structure coupled to the RF feed. The RF feed include a surface-current dispersing circuit. The antenna structure includes a ground plane and a folded monopole element coupled to the RF feed at a feeding point at near end (311, 611) of the folded monopole element and coupled to the ground plane at a grounding point at a distal end (313, 613) of the folded monopole element, the distal end (313, 613) being the farthest from the RF feed. Surface currents, generated as a result of the RF signals being applied to the RF feed at the feeding point, create a first hot spot of magnetic field at the feeding point. The surface-current dispersing circuit and the grounding point disperses a portion of the surface currents at the feeding point towards the grounding point to create a second hot spot of magnetic field at the grounding point. The first hot spot and the second hot spot are areas on the folded monopole element on which surface-current density is higher than on an area surrounding the first and second hot spot areas.

In another embodiment, a RF includes a surface-current dispersing circuit and an antenna structure coupled to the RF feed at a feeding point and coupled to a ground plane at a grounding point. The antenna structure includes an even multiple of quarter-wavelength elements with a first element coupled to the feeding point and a second element coupled to the grounding point. The grounding point is located at a specified distance from the feeding point. Surface currents, generated as a result of the RF signals being applied to the RF feed at the feeding point, create a first hot spot of an even multiple of hot spots of magnetic field at the feeding point. The surface-current dispersing circuit and the ground point disperse a portion of the surface currents at the feeding point towards the grounding point to create other hot spots of the even multiple of hot spots. The even multiple of hot spots are areas of the antenna structure on which surface-current density is higher than other areas surrounding the areas of the even multiple of hot spots.

In a further embodiment, the even multiple of quarter-wavelength elements are folded monopole elements, folded dipole elements, or loop elements. Alternatively, other types of antenna elements can be used. The specified distance may be at least ten millimeters. Alternatively, the specified distance can be greater than ten millimeters based on other factors, such as length of the antenna elements between the feeding point and the grounding point. In one embodiment, an effective length of the antenna structure is an integer multiple of a half wavelength and a number of pairs of the even multiple of hot spots is equal to the integer multiple. For example, a half wavelength antenna structure creates one pair of hot spots. For another example, a wavelength antenna structure creates two pair of hot spots (e.g., four hot spots).

In a further embodiment, the antenna structure is a folded monopole structure including a first quarter-wavelength monopole element having an L-shape coupled to the feeding point and a second quarter-wavelength monopole element having an L-shape coupled to the grounding point. The first monopole element and the second monopole element together form a U-shape with a first end of the U-shape coupled to the feeding point and a second end of the U-shape coupled to the grounding point. A perimeter of the U-shape has the effective length of half wavelength of the folded monopole element and the number of pairs of the even multiple of hot spots is one. Alternatively, the antenna structure includes four quarter-wavelength elements and the number of pairs of the even multiple of hot spots is two.

In another embodiment, the antenna structure is the folded monopole structure as described above with respect to FIG. 3 or the folded monopole structure as described above with respect to FIG. 6. The surface-current dispersing circuit includes a first inductive element coupled in series at the feeding point, a second inductive element coupled in parallel between the feeding point and the ground plane, and a first capacitive element coupled in series between the grounding point and the ground plane. In another embodiment, the surface-current dispersing circuit includes a first capacitive element coupled in series at the feeding point, a first inductive element coupled in parallel between the feeding point and the ground plane, and a second inductive element coupled in series between the grounding point and the ground plane. In one embodiment, the capacitive elements and the inductive elements are conductive strips as described herein. In another embodiment, the capacitive elements and the inductive elements are discrete components as described herein.

Figure 10:
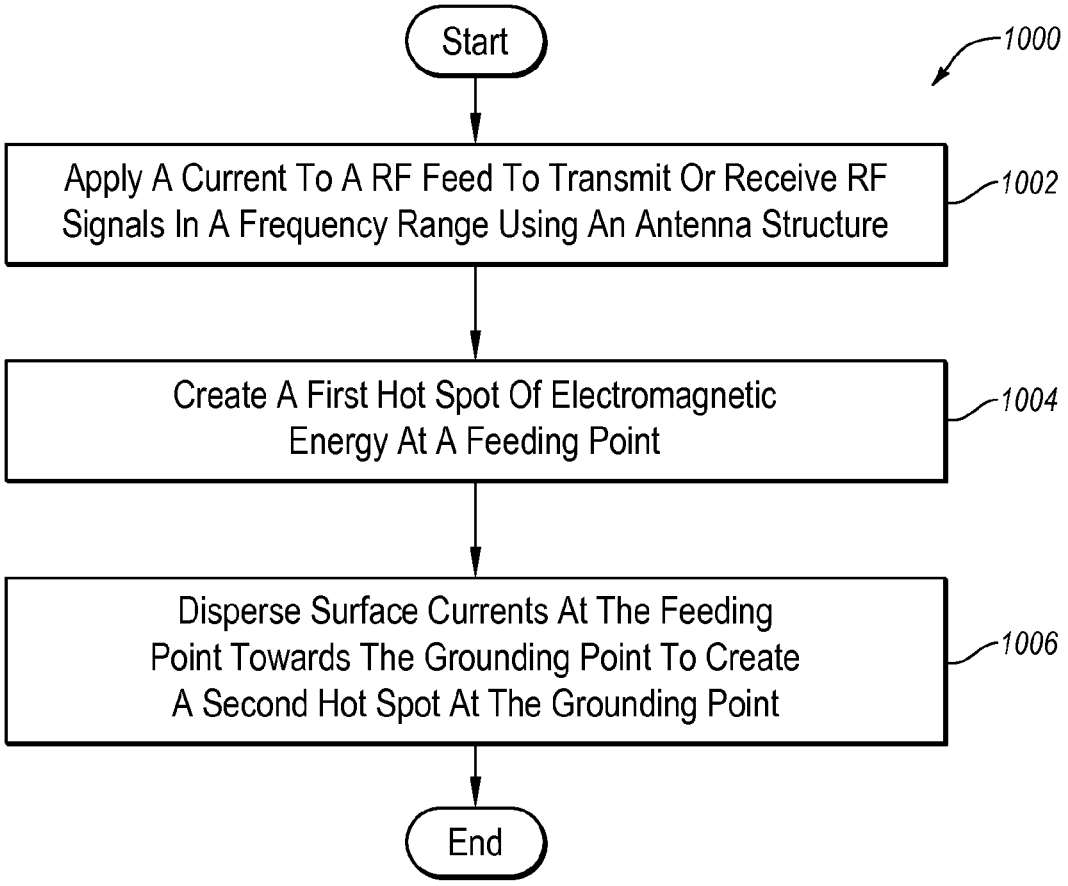
FIG. 10 is a flow diagram of an embodiment of a method of operating a user device having an antenna structure and a surface-current dispersing circuit according to one embodiment.

FIG. 10 is a flow diagram of an embodiment of a method 1000 of operating an electronic device having an antenna structure and a surface-current dispersing circuit according to one embodiment. In method 1000, a current is applied to a RF feed to transmit or receive RF signals in a frequency range using an antenna structure coupled to the RF feed at a feeding point (351 or 651) and coupled to a ground plane at a grounding point (353 or 653) that is a specified distance away from the feeding point (block 1002). The current applied to the RF feed creates surface currents on the antenna structure. When the current is applied to the RF feed, a first element of an even number of quarter-wavelength elements of the antenna structure and a surface-current dispersing circuit creates a first hot spot of an even multiple of hot spots of magnetic field at the feeding point (block 1004). A second element of the even number of quarter-wavelength elements and the surface-current dispersing circuit disperse a portion of the surface currents at the feeding point towards the grounding point to create other hot spots of the even multiple of hot spots (block 1106). The even multiple of hot spots are areas of the antenna structure on which a surface-current density is higher than other areas surrounding the hot spot areas.

In a further embodiment, applying the current at RF feed causes the antenna structure to radiate magnetic field in a resonant mode when the RF signals in a frequency range are applied to the RF feed. In one embodiment, the frequency range is centered at approximately 2.44 GHz. In another embodiment, the frequency range is centered at approximately 5.5 GHz. In response to the applied current, when applicable, the antenna structure radiates magnetic field to communicate information to one or more other devices. Regardless of the antenna configuration, the magnetic field forms a radiation pattern. The radiation pattern may be various shapes as would be appreciated by one of ordinary skill in the art having the benefit of this disclosure. Alternatively, other frequency ranges may be achieved as described herein.

Figure 11:
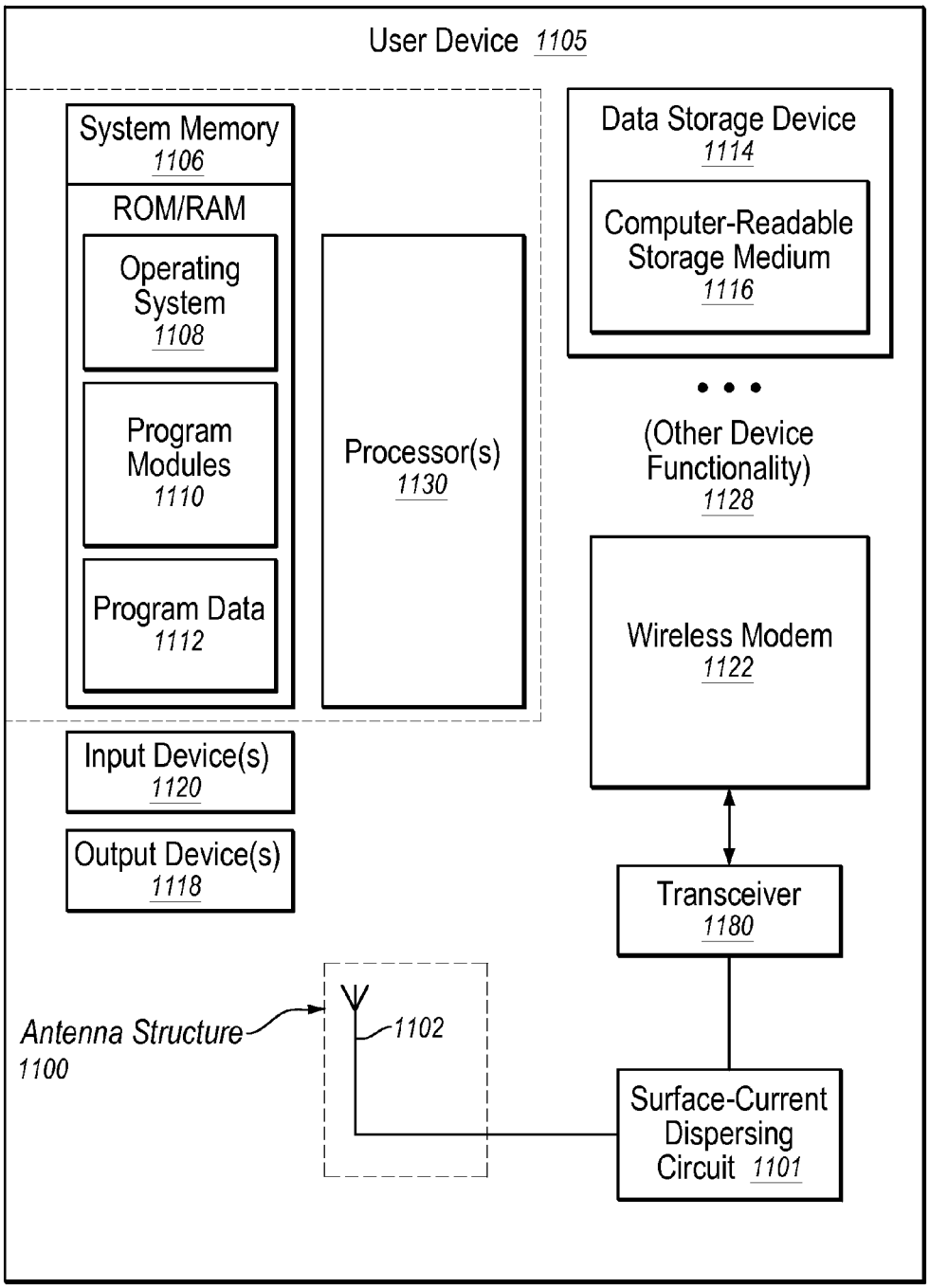
FIG. 11 is a block diagram of a user device in which embodiments of an antenna structure and a surface-current dispersing circuit may be implemented.

FIG. 11 is a block diagram of a user device 1105 having the antenna structure 1100 and a surface-current dispersing circuit 1101 according to one embodiment. The user device 1105 includes one or more processors 1130, such as one or more CPUs, microcontrollers, field programmable gate arrays, or other types of processing devices. The user device 1105 also includes system memory 1106, which may correspond to any combination of volatile and/or non-volatile storage mechanisms. The system memory 1106 stores information, which provides an operating system component 1108, various program modules 1110, program data 1112, and/or other components. The user device 1105 performs functions by using the processor(s) 1130 to execute instructions provided by the system memory 1106.

The user device 1105 also includes a data storage device 1114 that may be composed of one or more types of removable storage and/or one or more types of non-removable storage. The data storage device 1114 includes a computer-readable storage medium 1116 on which is stored one or more sets of instructions embodying any one or more of the functions of the user device 1105, as described herein. As shown, instructions may reside, completely or at least partially, within the computer-readable storage medium 1116, system memory 1106 and/or within the processor(s) 1130 during execution thereof by the user device 1105, the system memory 1106 and the processor(s) 1130 also constituting computer-readable media. The user device 1105 may also include one or more input devices 1120 (keyboard, mouse device, specialized selection keys, etc.) and one or more output devices 1118 (displays, printers, audio output mechanisms, etc.).

The user device 1105 further includes a wireless modem 1122 to allow the user device 1105 to communicate via a wireless network (e.g., such as provided by a wireless communication system) with other computing devices, such as remote computers, an item providing system, and so forth. The wireless modem 1122 allows the user device 1105 to handle both voice and non-voice communications (such as communications for text messages, multimedia messages, media downloads, web browsing, etc.) with a wireless communication system. The wireless modem 1122 may provide network connectivity using any type of digital mobile network technology including, for example, cellular digital packet data (CDPD), general packet radio service (GPRS), enhanced data rates for GSM evolution (EDGE), UMTS, 1 times radio transmission technology (1×RTT), evaluation data optimized (EVDO), high-speed downlink packet access (HSDPA), WLAN (e.g., Wi-Fi® network), etc. In other embodiments, the wireless modem 1122 may communicate according to different communication types (e.g., WCDMA, GSM, LTE, CDMA, WiMax, etc.) in different cellular networks. The cellular network architecture may include multiple cells, where each cell includes a base station configured to communicate with user devices within the cell. These cells may communicate with the user devices 1105 using the same frequency, different frequencies, same communication type (e.g., WCDMA, GSM, LTE, CDMA, WiMax, etc.), or different communication types. Each of the base stations may be connected to a private, a public network, or both, such as the Internet, a local area network (LAN), a public switched telephone network (PSTN), or the like, to allow the user devices 1105 to communicate with other devices, such as other user devices, server computing systems, telephone devices, or the like. In addition to wirelessly connecting to a wireless communication system, the user device 1105 may also wirelessly connect with other user devices. For example, user device 1105 may form a wireless ad hoc (peer-to-peer) network with another user device.

The wireless modem 1122 may generate signals and send these signals to transceiver 1180 for amplification, after which they are wirelessly transmitted via the antenna structure 1100 in connection with the surface-current dispersing circuit 1101. Although FIG. 11 illustrates the transceivers 1180, in other embodiments, a power amplifier (power amp) may be used for the antenna elements 1102 to transmit and receive RF signal. Or, receivers may be used instead of transceivers, such as a GPS receiver. The antenna structure 1100 may be any directional, omnidirectional or non-directional antenna in a different frequency band. In addition to sending data, the antenna structure 1100 also can receive data, which is sent to wireless modem 1122 and transferred to processor(s) 1130. The user device 1105 may include zero or more additional antennas (not illustrated) other than antenna structure 1100. When there are multiple antennas, the user device 1105 may also transmit information using different wireless communication protocols. It should be noted that, in other embodiments, the user device 1105 may include more or less components as illustrated in the block diagram of FIG. 11. In one embodiment, the antenna structure 1100 is the antenna structure 300 of FIG. 3. In another embodiment, the antenna structure 1100 is the antenna structure 600 of FIG. 6. Alternatively, the antenna structure 1100 may be other variants of the antenna structures as described herein. The surface-current dispersing circuit 1101 may be the surface-current dispersing circuit 301 of FIG. 3 or the surface-current dispersing circuit 601 of FIG. 6. Alternatively, the surface-current dispersing circuit 1101 may be other surface-current dispersing circuits as described herein.

In one embodiment, the user device 1105 establishes a first connection using a first wireless communication protocol, and a second connection using a different wireless communication protocol. The first wireless connection and second wireless connection may be active concurrently, for example, if a user device is downloading a media item from a server (e.g., via the first connection) and transferring a file to another user device (e.g., via the second connection) at the same time. Alternatively, the two connections may be active concurrently during a handoff between wireless connections to maintain an active session (e.g., for a telephone conversation). Such a handoff may be performed, for example, between a connection to a WLAN hotspot and a connection to a wireless carrier system. In one embodiment, the first wireless connection is associated with a first resonant mode of the antenna structure 1100 that operates at a first frequency band and the second wireless connection is associated with a second resonant mode of the antenna structure 1100 that operates at a second frequency band. In another embodiment, the first wireless connection is associated with the first antenna element 1102 of the antenna structure 1100 and the second wireless connection is associated with a second antenna (not illustrated). In other embodiments, the first wireless connection may be associated with a media purchase application (e.g., for downloading electronic books), while the second wireless connection may be associated with a wireless ad hoc network application. Other applications that may be associated with one of the wireless connections include, for example, a game, a telephony application, an Internet browsing application, a file transfer application, a global positioning system (GPS) application, and so forth.

Though a wireless modem 1122 is shown to control transmission and reception via antenna structure 1100, the user device 1105 may alternatively include multiple wireless modems, each of which is configured to transmit/receive data via a different antenna and/or wireless transmission protocol.

The user device 1105 delivers and/or receives items, upgrades, and/or other information via the network. For example, the user device 1105 may download or receive items from an item providing system. The item providing system receives various requests, instructions and other data from the user device 1105 via the network. The item providing system may include one or more machines (e.g., one or more server computer systems, routers, gateways, etc.) that have processing and storage capabilities to provide the above functionality. Communication between the item providing system and the user device 1105 may be enabled via any communication infrastructure. One example of such an infrastructure includes a combination of a wide area network (WAN) and wireless infrastructure, which allows a user to use the user device 1105 to purchase items and consume items without being tethered to the item providing system via hardwired links. The wireless infrastructure may be provided by one or multiple wireless communications systems, such as one or more wireless communications systems. One of the wireless communication systems may be a wireless local area network (WLAN) hotspot connected with the network. The WLAN hotspots can be created by Wi-Fi® products based on IEEE 802.11x standards by Wi-Fi Alliance. Another of the wireless communication systems may be a wireless carrier system that can be implemented using various data processing equipment, communication towers, etc. Alternatively, or in addition, the wireless carrier system may rely on satellite technology to exchange information with the user device 1105.

The communication infrastructure may also include a communication-enabling system that serves as an intermediary in passing information between the item providing system and the wireless communication system. The communication-enabling system may communicate with the wireless communication system (e.g., a wireless carrier) via a dedicated channel, and may communicate with the item providing system via a non-dedicated communication mechanism, e.g., a public Wide Area Network (WAN) such as the Internet.

The user devices 1105 are variously configured with different functionality to enable consumption of one or more types of media items. The media items may be any type of format of digital content, including, for example, electronic texts (e.g., eBooks, electronic magazines, digital newspapers, etc.), digital audio (e.g., music, audible books, etc.), digital video (e.g., movies, television, short clips, etc.), images (e.g., art, photographs, etc.), and multi-media content. The user devices 1105 may include any type of content rendering devices such as electronic book readers, portable digital assistants, mobile phones, laptop computers, portable media players, tablet computers, cameras, video cameras, netbooks, notebooks, desktop computers, gaming consoles, DVD players, media centers, and the like.

In the above description, numerous details are set forth. It will be apparent, however, to one of ordinary skill in the art having the benefit of this disclosure, that embodiments may be practiced without these specific details. In some instances, well-known structures and devices are shown in block diagram form, rather than in detail, in order to avoid obscuring the description.

Some portions of the detailed description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "inducing," "parasitically inducing," "radiating," "detecting," determining," "generating," "communicating," "receiving," "disabling," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Embodiments also relate to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but not limited to, any type of disk including floppy disks, optical disks, CD-ROMs and magnetic-optical disks, read-only memories (ROMs), random access memories (RAMs), EPROMs, EEPROMs, magnetic or optical cards, or any type of media suitable for storing electronic instructions.

The algorithms and displays presented herein are not inherently related to any particular computer or other apparatus. Various general-purpose systems may be used with programs in accordance with the teachings herein, or it may prove convenient to construct a more specialized apparatus to perform the required method steps. The required structure for a variety of these systems will appear from the description below. In addition, the present embodiments are not described with reference to any particular programming language. It will be appreciated that a variety of programming languages may be used to implement the teachings of the present invention as described herein. It should also be noted that the terms "when" or the phrase "in response to," as used herein, should be understood to indicate that there may be intervening time, intervening events, or both before the identified operation is performed.

It is to be understood that the above description is intended to be illustrative, and not restrictive. Many other embodiments will be apparent to those of skill in the art upon reading and understanding the above description. The scope of the present embodiments should, therefore, be determined with reference to the appended claims, along with the full scope of equivalents to which such claims are entitled.

What is claimed is:

1. An electronic device comprising:

a transceiver to transmit or receive radio frequency (RF) signals;

a surface-current dispersing circuit;

an RF feed coupled to the transceiver and the surface-current dispersing circuit; and an antenna structure coupled to the RF feed, wherein the antenna structure comprises:

a ground plane; and a folded monopole element coupled to the RF feed at a feeding point at near end of the folded monopole element and coupled to the ground plane at a grounding point at a distal end of the folded monopole element, the distal end being the farthest from the RF feed, wherein surface currents, generated as a result of the RF signals being applied to the RF feed, create a first hot spot of magnetic field at the feeding point, wherein the surface-current dispersing circuit and the grounding point disperse a portion of the surface currents at the feeding point towards the grounding point to create a second hot spot of magnetic field at the grounding point, wherein the first hot spot and the second hot spot are areas on the folded monopole element and wherein surface-current density over the first and second hot spot areas is higher than over an area surrounding the first and the second hot spot areas.

2. The electronic device of claim 1, wherein the folded monopole element comprises:

a first arm portion that extends from the feeding point to a first junction in a first direction;

a second arm portion that extends from the first junction in a second direction towards a second junction;

a third arm portion that extends from the second junction in a third direction towards a third junction; and a fourth arm portion that extends from the third junction in a fourth direction towards a fourth junction, wherein the fourth arm portion is coupled to the grounding point at an opposite end from the third junction, wherein the fourth arm portion is parallel to the ground plane and coupled to the grounding point at an opposite end of the third junction, wherein the third direction is parallel to the first direction and the fourth direction is parallel to the second direction, and wherein the surface-current dispersing circuit comprises:

a first inductive element coupled in series between the RF feed and the feeding point at the opposite end of the first arm portion;

a second inductive element coupled in parallel between the ground plane and the feeding point at the opposite end of the first arm portion; and a first capacitive element coupled in series between the ground plane and the grounding point at the opposite end of the fourth arm portion.

3. The electronic device of claim 1, wherein the folded monopole element comprises:

a first arm portion that extends parallel to the ground plane in a first direction towards a first junction, wherein the first arm portion is coupled to the feeding point at an opposite end from the first junction;

a second arm portion that extends from the first junction in a second direction towards a second junction;

a third arm portion that extends from the second junction in a third direction towards a third junction; and a fourth arm portion that extends from the third junction in a fourth direction towards the grounding point, wherein the fourth arm portion is coupled to the grounding point at an opposite end from the third junction, wherein the third direction is parallel to the first direction and the fourth direction is parallel to the second direction, and wherein the surface-current dispersing circuit comprises:

a first capacitive element coupled in series between the RF feed and the feeding point at the opposite end of the first arm portion;

a first inductive element coupled in parallel between the ground plane and the feeding point at the opposite end of the first arm portion; and a second inductive element coupled in series between the ground plane and the grounding point at the opposite end of the fourth arm portion.

4. The electronic device of claim 1, wherein the folded monopole element comprises:

a first monopole element having an L-shape coupled to the feeding point; and a second monopole element having an L-shape coupled to the grounding point, wherein the first monopole element and the second monopole element are coupled together to form a U-shape with a first end of the U-shape coupled to the feeding point and a second end of the U-shape coupled to the grounding point, wherein a perimeter of the U-shape is equal to half wavelength of the folded monopole element, wherein the grounding point is located at a specified distance from the feeding point, wherein the specified distance is ten millimeters or greater, and wherein the folded monopole element radiates magnetic field in a resonant mode when the RF signals centered at approximately 2.44 GHz are applied to the RF feed.

5. An apparatus comprising:

a surface-current dispersing circuit;

a radio frequency (RF) feed coupled to the surface-current dispersing circuit; and an antenna structure coupled to the RF feed at a feeding point and coupled to a ground plane at a grounding point, wherein the antenna structure comprises an even multiple of quarter-wavelength elements with a first element coupled to the feeding point and a second element coupled to the grounding point, wherein the grounding point is located at a specified distance from the feeding point, wherein surface currents, generated as a result of RF signals being applied to the RF feed at the feeding point, create a first hot spot of magnetic field at the feeding point, wherein the surface-current dispersing circuit and the ground point disperse a portion of the surface currents at the feeding point towards the grounding point to create a second hot spot, and wherein the first and the second hot spots are areas of the antenna structure over which surface-current density is higher than other areas surrounding the first and second hot spots.

6. The apparatus of claim 5, wherein the even multiple of quarter-wavelength elements are monopole elements or dipole elements.

7. The apparatus of claim 5, wherein the surface-current dispersing circuit comprises:

a first inductive element coupled in series between the feeding point and the RF feed;

a second inductive element coupled in parallel between the feeding point and the ground plane; and a first capacitive element coupled in series between the grounding point and the ground plane.

8. The apparatus of claim 7, wherein the first inductive element is a first conductive strip with a first inductance, the second inductive element is a second conductive strip with a second inductance and the first capacitive element is a third conductive strip with a first capacitance.

9. The apparatus of claim 7, wherein the first inductive element, the second inductive element and the first capacitive element are discrete components.

10. The apparatus of claim 5, wherein the specified distance is at least ten millimeters.

11. The apparatus of claim 5, wherein the antenna structure comprises four quarter-wavelength elements comprising the first element and the second element, and two additional elements, wherein the surface-current dispersing circuit and the ground point disperse additional portions of the surface currents at the feeding point and the grounding point to create a third hot spot and a fourth hot spot, wherein the third and fourth hot spots are areas of the antenna structure over which surface-current density is higher than other areas surrounding the first, second, third and fourth hot spots.

12. The apparatus of claim 5, wherein the antenna structure is a folded monopole structure comprising:

a first quarter-wavelength monopole element having an L-shape coupled to the feeding point; and a second quarter-wavelength monopole element having an L-shape coupled to the grounding point, wherein the first monopole element and the second monopole element together form a U-shape with a first end of the U-shape coupled to the feeding point and a second end of the U-shape coupled to the grounding point, wherein a perimeter of the U-shape has an effective length of half wavelength of the folded monopole structure, and wherein a number of pairs of the even multiple of hot spots is one.

13. The apparatus of claim 5, wherein the antenna structure is a folded monopole structure comprising:

a first arm portion that extends from the feeding point to a first junction in a first direction;

a second arm portion that extends from the first junction in a second direction towards a second junction;

a third arm portion that extends from the second junction in a third direction towards a third junction; and a fourth arm portion that extends from the third junction in a fourth direction towards a fourth junction, wherein the fourth arm portion is coupled to the grounding point at an opposite end from the third junction, wherein the fourth arm portion is parallel to the ground plane and coupled to the grounding point at an opposite end of the third junction, and wherein the third direction is parallel to the first direction and the fourth direction is parallel to the second direction.

14. The apparatus of claim 5, wherein the antenna structure is a folded monopole structure comprising:

a first arm portion that extends parallel to the ground plane in a first direction towards a first junction, wherein the first arm portion is coupled to the feeding point at an opposite end from the first junction;

a second arm portion that extends from the first junction in a second direction towards a second junction;

a third arm portion that extends from the second junction in a third direction towards a third junction; and a fourth arm portion that extends from the third junction in a fourth direction towards the grounding point, wherein the fourth arm portion is coupled to the grounding point at an opposite end from the third junction, wherein the third direction is parallel to the first direction and the fourth direction is parallel to the second direction.

15. The apparatus of claim 14, wherein the surface-current dispersing circuit comprises:

a first capacitive element coupled in series between the RF feed and the feeding point at the opposite end of the first arm portion;

a first inductive element coupled in parallel between the ground plane and the feeding point at the opposite end of the first arm portion; and a second inductive element coupled in series between the ground plane and the grounding point at the opposite end of the fourth arm portion.

16. The apparatus of claim 15, wherein the first capacitive element is a first conductive strip with a first capacitance, the first inductive element is a second conductive strip with a first inductance and the second inductive element is a third conductive strip with a second inductance.

17. The apparatus of claim 5, wherein the antenna structure radiates electromagnetic energy in a resonant mode when the RF signals in a frequency range, centered at approximately 2.44 GHz or 5.5 GHz, are applied to the RF feed.

18. A method of operating an electronic device, the method comprising:

applying a current to a radio frequency (RF) feed to transmit or receive RF signals in a frequency range using an antenna structure coupled to the RF feed at a feeding point and coupled to a ground plane at a grounding point that is a specified distance away from the feeding point, wherein the current applied to the RF feed creates surface currents on the antenna structure;

creating, by a first element of an even number of quarter-wavelength elements of the antenna structure and a surface-current dispersing circuit, a first hot spot of an even multiple of hot spots of magnetic field at the feeding point when the current is applied to the RF feed; and dispersing, by a second element of the even number of quarter-wavelength elements and the surface-current dispersing circuit, a portion of the surface currents at the feeding point towards the grounding point to create other hot spots of the even multiple of hot spots, wherein the even multiple of hot spots are areas of the antenna structure on which surface-current density is higher than other areas surrounding the areas of the even multiple of hot spots.

19. The method of claim 18, wherein the applying the current causes the antenna structure to radiate magnetic field in a resonant mode when the RF signals in a frequency range, centered at approximately 2.44 GHz, are applied to the RF feed.

20. The method of claim 18, wherein the applying the current causes the antenna structure to radiate magnetic field in a resonant mode when the RF signals in a frequency range, centered at approximately 5.5 GHz, are applied to the RF feed.

* * * * *